US005527429A

United States Patent [19]

Dambreville et al.

[11] Patent Number: 5,527,429

[45] Date of Patent: Jun. 18, 1996

[54] METHOD OF PREPARING PAPER FOR FILTER BAGS, APPARATUS FOR IMPLEMENTING THE METHOD, AND PRODUCT OBTAINED THEREBY

[75] Inventors: Abel Dambreville, Rosporden; Roger Le Fol; Philippe Deleplanque, both of Quimper; Yves Le Brech, Scaer, all of France

[73] Assignee: Papeteries de Cascadec, Ergue Gaberic, France

[21] Appl. No.: 61,271

[22] Filed: May 12, 1993

Related U.S. Application Data

[63] Continuation of Ser. No. 665,035, Mar. 6, 1991, abandoned.

[30] Foreign Application Priority Data

Mar. 8, 1990 [FR] France ..... 90 02959

[51] Int. Cl.[6] ..... D21H 13/00

[52] U.S. Cl. ..... 162/129; 162/109; 162/157.1; 55/528; 55/382; 210/508; 428/198

[58] Field of Search ..... 162/109, 116–117, 162/129, 206, 207, 361, 362, 377, 157.1–157.7; 426/84, 77; 156/199, 209, 324, 166, 308.2; 210/507, 508, 490; 428/198, 179, 171, 172, 286, 287; 55/528, 382; 264/DIG. 48, 113, 284

[56] References Cited

U.S. PATENT DOCUMENTS

| | | | |
|---|---|---|---|
| 3,323,983 | 6/1967 | Palmer | 162/117 |
| 3,350,260 | 10/1967 | Johnson | 162/116 |
| 3,470,052 | 9/1969 | Herman | 156/209 |
| 3,478,141 | 11/1969 | Demsey et al. | 156/209 |
| 3,775,244 | 11/1973 | Hubschmann | 162/109 |
| 4,135,024 | 1/1979 | Callahan | 162/117 |
| 4,289,580 | 9/1981 | Elston et al. | 162/109 |
| 4,590,114 | 5/1986 | Holtman | 156/209 |
| 4,770,920 | 9/1988 | Larsonneur | 156/209 |
| 5,173,154 | 12/1992 | Heinrich | 162/129 |

FOREIGN PATENT DOCUMENTS

| | | | |
|---|---|---|---|
| 2227960 | 4/1974 | France . | |
| 3312484 | 10/1983 | Germany . | |
| 3159599 | 7/1988 | Japan | 162/148 |
| 8101429 | 5/1981 | WIPO . | |

OTHER PUBLICATIONS

Pulp and Paper, Chemistry and Chemical Technology, vol. III, 3rd Edition (Casey) New York, N.Y. pp. 1751–1755.

Abstract Bulletin Of The Institute Of Paper Chemistry, vol. 51, No. 6, Dec. 1980, Appleton, US. p. 680 S. Ohyama, "Manufacture of Filter Paper".

*Primary Examiner*—Brenda A. Lamb

*Attorney, Agent, or Firm*—Blakely, Sokoloff, Taylor & Zafman

[57] ABSTRACT

A method of preparing paper for filter bags, the method of the type comprising a step during which a non-woven paper is prepared comprising two superposed layers, namely a layer based on synthetic fibers and a layer of cellulose fibers, by a technique which is known per se, wherein the method includes a subsequent step of subjecting the non-woven paper to a calendering operation between a support structure and a heated cylinder having projections. The present invention also provides apparatus for implementing the method and products obtained in this manner.

9 Claims, 1 Drawing Sheet

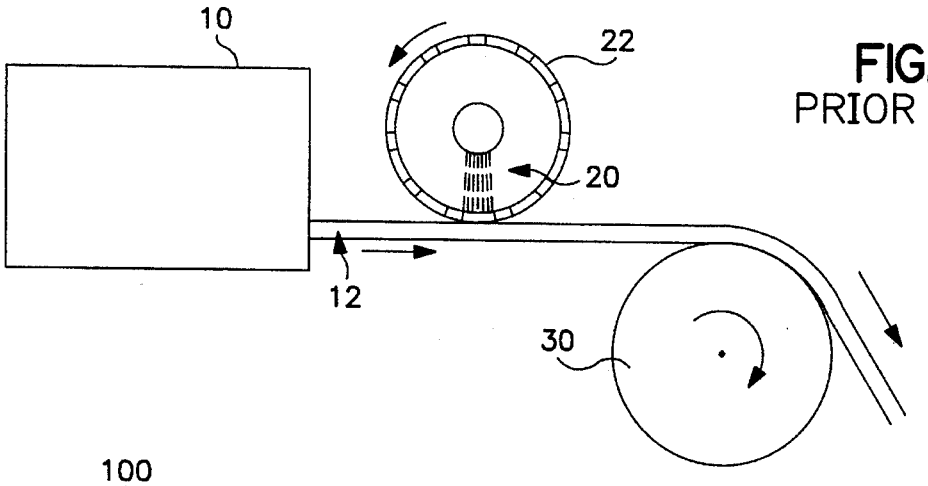
FIG. 1
PRIOR ART
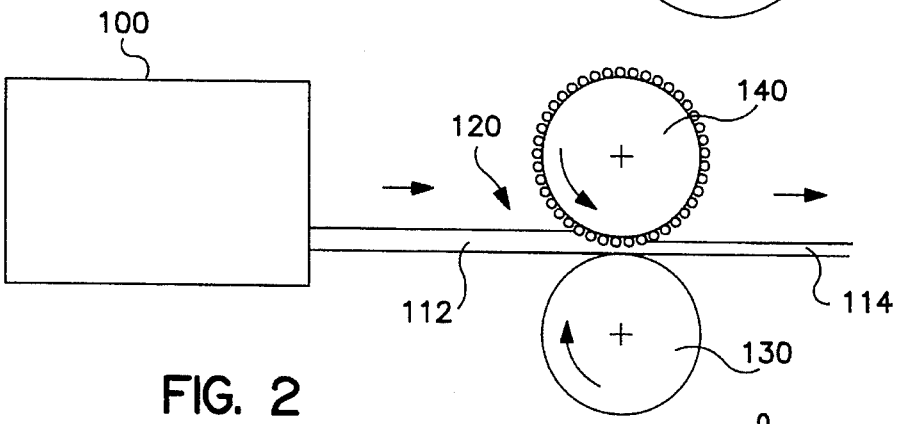
FIG. 2
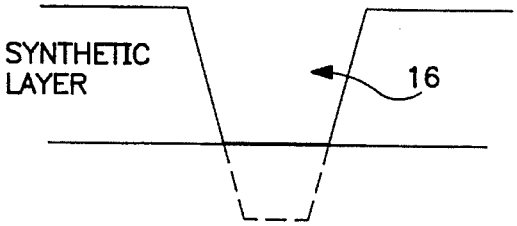
FIG. 3A
PRIOR ART
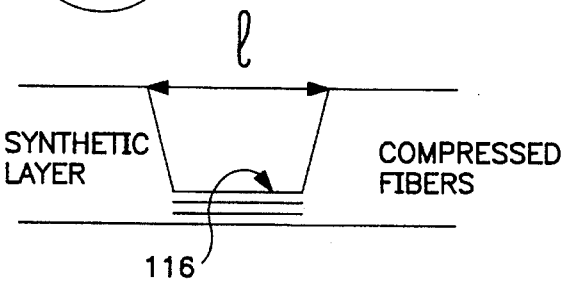
FIG. 3B
FIG. 4A
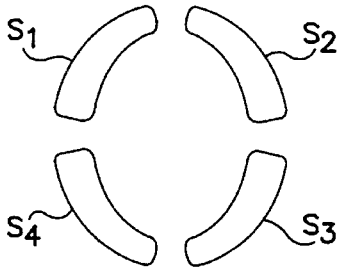
FIG. 4B
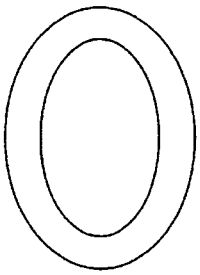

METHOD OF PREPARING PAPER FOR FILTER BAGS, APPARATUS FOR IMPLEMENTING THE METHOD, AND PRODUCT OBTAINED THEREBY

This is a continuation of application Ser. No. 07/665,035 filed Mar. 6, 1991, now abandoned.

The present invention relates to preparing paper for filter bags.

In the present application, the term "filter bag" is used to designate bags for infusion purposes, in particular tea bags or bags of medicinal plants, and coffee bags or the like.

In the context of the present application, the term "bag" is used to cover packaging delivered to the user in the full and closed state, as well as bags that are delivered open, e.g. in the form of a cone, and which are filled by the consumer, before use. The term "bag" is not limited to any particular shape. For example, it covers the generally cylindrical packaging obtained for goods that are packaged in the compressed state, e.g. coffee bags.

More precisely, the present invention relates to preparing paper for filter bags, the paper being of the type comprising a non-woven structure composed of two superposed layers, namely a layer based on synthetic fibers, and a layer of cellulose fibers, the paper having a particular apparent texture or repetitive pattern, such as semi-perforations at regular intervals, for example.

BACKGROUND OF THE INVENTION

As shown diagrammatically in accompanying FIG. 1, textured filter paper is generally prepared by means of a conventional method that consists in using a machine 10 to prepare a non-woven structure 12 in conventional manner, the structure 12 comprising two superposed layers, namely a layer based on synthetic fibers and a layer of cellulose fibers, after which:

a) a series of fluid jets 20 are applied to the non-woven structure 12 to texture the paper in a selected pattern; and then b) the textured non-woven structure is subjected to a heating operation in order to fix the synthetic fibers.

The fluid jet texturing operation is generally performed by spraying jets of fluid 20 onto the paper 12 through a rotary cylinder 22 having openings or through a moving strip likewise having openings (not shown). During this operation, the paper 12 must naturally be supported by support means which are omitted from FIG. 1 to simplify the illustration. The fluid used is generally water. This fluid jet texturing technique is well known to the person skilled in the art and has given rise to abundant literature.

The hot fixing operation is generally performed by passing the textured paper over a rotary cylinder 30 provided with heater means. For example, the cylinder 30 may be heated to a temperature of about 200° C. It may optionally be of the "through air" type designed to blow hot air through the sheet. It may also be replaced by a hot air tunnel oven.

An object of the present invention is to propose a novel method of preparing paper for filter bags, which method makes it possible to improve the properties of the product obtained.

SUMMARY OF THE INVENTION

According to the present invention, this object is achieved by a method of preparing paper for filter bags, which method includes, after making non-woven paper comprising two superposed layers, namely a layer based on synthetic fibers and a layer of cellulose fibers by means of a technique known per se, the step of subjecting the non-woven paper to a calendering operation between a support structure and a heated cylinder having projections.

Advantageously, the heated cylinder is a metal cylinder.

Advantageously, the support structure is constituted by a cylinder having a smooth surface.

Advantageously, the support structure is constituted by a cylinder having depressions complementary to the projections on the metal cylinder.

Advantageously, the support structure is formed by a cylinder having a resilient flexible outside surface, e.g. a rubber-coated cylinder.

Advantageously, the thrust pressure between the support structure and the heated cylinder having projections is adjustable.

The invention also provides apparatus for implementing the method, and the resulting product.

BRIEF DESCRIPTION OF THE DRAWING

An embodiment of the invention is described by way of example with reference to the accompanying drawing, in which:

FIG. 1 is a diagrammatic view of a conventional method of preparing paper for filter bags;

FIG. 2 is a diagram showing the method of the present invention;

FIGS. 3A and 3B are diagrammatic sections showing the structure of the paper obtained respectively by implementing the conventional method shown in FIG. 1 and the method of the present invention shown in FIG. 2; and FIGS. 4A and 4B are diagrams showing two symbols respectively obtained using the conventional technique and using the present invention.

DETAILED DESCRIPTION

As shown in FIG. 2, and as mentioned above, the method of the present invention consists in:

i) using a conventional machine 100 and applying a technique known per se to make non-woven paper 112 comprising two superposed layers, namely a layer based on synthetic fibers and a layer of cellulose; then ii) subjecting the non-woven paper 112 to a calendering operation 120 between a support structure 130 and a heated cylinder 140 having projections.

The heated cylinder 140 having projections is preferably a metal cylinder, while the support structure is preferably constituted by a rubber-coated roller, which is preferably smooth.

Alternatively, as mentioned above, the support structure may be formed by a cylinder having depressions complementary to the projections on the cylinder 140.

The metal roller 140 having projections and the support roller 130 are rotated in the travel direction of the non-woven paper 112 and at the same speed as the paper.

Naturally, where appropriate, the cylinders 130 and 140 could be replaced by equivalent endless-belt structures.

The cylinder 140 having projections may be heated by any conventional means known to the person skilled in the art.

The thrust pressure between the cylinders 130 and 140 is preferably adjustable.

The layer of synthetic fibers in the non-woven paper 112 is preferably placed adjacent to the heated cylinder 140 having projections. However, the opposite configuration could be used, in particular to limit adherence between the paper and the heated cylinder, when operating at high speed.

Thus, on passing between the rollers 130 and 140, the synthetic fibers of the non-woven paper 112 are melted in part by the calendering action which is exerted by the projections on the cylinder 140.

As a result, after passing between the cylinders 130 and 140, the projections of the cylinder 140 can be seen in the appearance of the calendered non-woven paper 114.

The method of the present invention offers numerous advantages compared with the conventional prior art method shown in FIG. 1.

These advantages include the following:

a) The method of the present invention requires only one treatment station downstream from the apparatus 100 generating the two-layer non-woven paper 112, whereas the prior method shown in FIG. 1 requires two treatment stations corresponding respectively to the station for water jet texturing and the heating station for fixing the synthetic fibers. As a result, manufacturing plant in accordance with the present invention is smaller and easier to adjust. In particular, there is no need to synchronize the speed between the two separate treatment stations of the prior art.

b) The method of the present invention does not consume any water for texturing the paper.

c) The method of the present invention avoids regulating the difficult-to-control water flow rate.

d) The patterns corresponding to the projections on the cylinder 140 obtained by applying the invention are sharper than the patterns textured by water jets using the conventional prior art technique.

e) The method of the present invention enables a wider variety of patterns to be obtained than is possible in the prior art. The configuration and the size of the patterns obtained using the prior art are limited by the perforated fraction of the perforated cylinder 22. In addition, the conventional texturing technique using water jets passing through a cylinder 22 having perforations makes it impossible to provide closed loop patterns.

For example, the conventional technique cannot produce the letter "O" in the form of a continuous closed symbol. In the conventional technique, the letter "O" has to be built up in the form of a plurality of separate segments S1, S2, S3, and S4 as shown diagrammatically in FIG. 4A.

The present invention has no difficulty in producing such closed loop patterns, as shown in FIG. 4B.

f) The present invention makes it possible to transform plant manufacturing a given pattern on paper quickly into plant giving a different pattern, merely by changing the cylinder 140 having the projections, whereas in the conventional prior art technique, changing the cylinder 22 requires careful adjustments, in particular with respect to fluid flow rate as a function of the sizes of the perforations in the cylinder.

As a result, the method of the present invention makes it possible to achieve better regularity and also better reproducibility of the paper obtained, from one production run to another.

g) Finally, and above all, whereas conventional water jet texturing as shown in FIG. 3A displaces fibers and therefore provides localized perforations 16 through the synthetic layer, the texturing method by calendering proposed by the invention merely gives rise to localized compression 116 in the layer of synthetic fibers.

There is a risk of the water jet texturing technique also perforating the cellulose layer (as shown in dashed lines in FIG. 3A) and thus establishing weak points through which dust may pass. This drawback is totally eliminated by the method of the invention, which thus enables filter paper to be manufactured Without the usual drawback of textured paper, in other words it provides paper that is better at retaining very fine particles.

The projecting patterns on the cylinder 140 and reproduced on the paper may be very varied.

In particular, the Applicant has made papers having patterns in the form of dashes, squares, and losanges.

According to an advantageous characteristic of the present invention, the width of the projections on the cylinder 140, i.e. the width l of the compressed zones 116 is about 0.1 mm to about 5 mm, and is preferably in the range 0.1 mm to 2 mm, and is most preferably about 1 mm.

According to another advantageous characteristic of the present invention, the total area of the compressed zones 116 is less than one-fifth, and most preferably less than one-tenth of the total area of the paper.

The running speed of the paper 112, 114 may be about 200 meters per minute.

The composition of the paper may be as follows: the cellulose fibers may be wood pulp, hemp, flax, etc. . . . ; and the synthetic fibers may be: polyethylene, PVC, polypropylene, etc.

The fibers are advantageously a few millimeters long having a diameter of a few μm.

The thickness of the cellulose layer is typically about 25 μm to about 40 μm while the thickness of the synthetic layer is typically about 10 μm to about 15 μm.

The relative density of the paper may be about 0.3.

In a particular embodiment, the roller 140 with projections is made of steel. It may be heated by a flow of oil to a temperature of 140° C. to 300° C. The thrust pressure between the cylinders may be adjusted in the range 15 to 45 newtons per millimeter of width.

Where applicable, an additional heating stage similar to the conventional stage 30 may be performed before or after calendering 120. However, such a heating operation is generally not necessary in the context of the present invention.

Naturally, the present invention is not limited to the particular implementation described and extends to any variant coming within the spirit of the invention.

We claim:

1. Non-woven paper for filter bags designed for infusion purposes comprising:

a first layer of synthetic fibers having a constant thickness throughout the total area of said non-woven paper except where each of a plurality of repetitive calendered symbols is located, wherein the synthetic fibers are melted and compressed to a thickness about the thickness of said first layer by calendering to form said calendered symbols having a width in a range of 0.1 mm to 5.0 mm, so that the appearance of said repetitive calendered symbols differs from the appearance of other parts of said first layer and form an apparent repetitive texture, and said calendered symbols have a total=area which is less than one-fifth of the total area of said non-woven paper; and a second layer of cellulose fibers having a constant thickness throughout said non-woven paper.

2. Paper according to claim 1, wherein said calendered symbols have a width of about 1 mm.

3. Paper according to claim 1, wherein said first layer of synthetic fibers has a thickness which is between 10 μm and 15 μm.

4. Paper according to claim 1, wherein said second layer of cellulose fibers has a thickness which is between 25 μm and 40 μm.

5. Paper according to claim 1, wherein said synthetic fibers comprise polyethylene, polyvinyl chloride and polypropylene.

6. Non-woven paper for filter bags designed for infusion purposes comprising:

a first layer of synthetic fibers having a constant thickness between 10 μm and 15 μm throughout the total area of said non-woven paper except where each of a plurality of repetitive calendered symbols is located, wherein the synthetic fibers are melted and compressed to a thickness about the thickness of said first layer by calendering to form said calendered symbols having a width in a range of 0.1 mm to 5.0 mm, so that the appearance of said repetitive calendered symbols differs from the appearance of other parts of said first layer and form an apparent repetitive texture, and said calendered symbols have a total area which is less than one-fifth of the total area of said non-woven paper; and a second layer of cellulose fibers having a constant thickness throughout said non-woven paper.

7. Paper according to claim 6, wherein said calendered symbols have a width of about 1 mm.

8. Paper according to claim 6, wherein said second layer of cellulose fibers has a thickness which is between 25 μm and 40 μm.

9. Paper according to claim 6, wherein said synthetic fibers comprise polyethylene, polyvinyl chloride and polypropylene.

* * * * *

UNITED STATES PATENT AND TRADEMARK OFFICE

CERTIFICATE OF CORRECTION

PATENT NO. : 5,527,429

DATED : June 18, 1996

INVENTOR(S) : Dambreville et al.

It is certified that errors appear in the above-identified patent and that said Letters Patent is hereby corrected as shown below:

In column 4 at line 10, please delete " Without " and insert -- without --.

In column 4 at line 66, please delete " total=area " and insert -- total area --.

Signed and Sealed this

Eighth Day of October, 1996

Bruce Lehman

*Attest:*

BRUCE LEHMAN

*Attesting Officer*

*Commissioner of Patents and Trademarks*